US010274222B2

(12) United States Patent
Kashihara et al.

(10) Patent No.: US 10,274,222 B2
(45) Date of Patent: Apr. 30, 2019

(54) FAN UNIT AND AIR CONDITIONER

(71) Applicant: DAIKIN INDUSTRIES, LTD., Osaka-shi, Osaka (JP)

(72) Inventors: Takashi Kashihara, Sakai (JP); Takahiro Yamasaki, Sakai (JP); Kaname Maruyama, Sakai (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 1268 days.

(21) Appl. No.: 14/482,269

(22) Filed: Sep. 10, 2014

(65) Prior Publication Data

US 2015/0071775 A1 Mar. 12, 2015

(30) Foreign Application Priority Data

Sep. 11, 2013 (JP) ..... 2013-188510

(51) Int. Cl.
*F24F 13/20* (2006.01)
*F24F 1/0007* (2019.01)

(52) U.S. Cl.
CPC ..... *F24F 13/20* (2013.01); *F24F 1/0007* (2013.01)

(58) Field of Classification Search
CPC ..... F24F 13/20; F24F 2013/205; F24F 2013/202; F04D 29/403; F04D 29/4226
USPC ..... 415/206, 178
See application file for complete search history.

(56) References Cited

U.S. PATENT DOCUMENTS

| | | | | |
|---|---|---|---|---|
| 4,917,572 | A | 4/1990 | Van Houten | |
| 2010/0071868 | A1* | 3/2010 | Reifel | B23P 15/26 165/47 |
| 2015/0219348 | A1* | 8/2015 | Ikeda | F24F 1/0018 454/249 |

FOREIGN PATENT DOCUMENTS

| | | | |
|---|---|---|---|
| JP | 59-93130 | A | 5/1984 |
| JP | 6-281194 | A | 10/1994 |
| JP | 8-312994 | A | 11/1996 |
| JP | 9-209988 | A | 8/1997 |
| JP | 11-324990 | A | 11/1999 |
| JP | 2001-304610 | A | 10/2001 |
| JP | 2011-202821 | A | 10/2011 |

* cited by examiner

*Primary Examiner* — Justin D Seabe
*Assistant Examiner* — Jason Mikus
(74) *Attorney, Agent, or Firm* — Birch, Stewart, Kolasch & Birch, LLP

(57) ABSTRACT

A fan unit includes a fan case, a partition member and a centrifugal fan. The fan case has an inflow port and a blowout port. The fan case includes a unit connecting portion for connecting the heat exchange unit. The partition member partitions an inside of the fan case into an upstream side space and a downstream side space. The partition member has an opening for allowing the upstream side space and the downstream side space to communicate with each other. The centrifugal fan includes an impeller including a plurality of backward curved blades. The centrifugal fan is arranged such that the impeller is located in the downstream side space and sucks air in the upstream side space through the opening. The blowout port is located on an outer side in a radial direction of the impeller in the downstream side space.

7 Claims, 9 Drawing Sheets

FAN UNIT AND AIR CONDITIONER

TECHNICAL FIELD

The present invention relates to a fan unit to be connected to a heat exchange unit in which a heat exchanger is housed, and relates to an air conditioner.

BACKGROUND ART

Japanese Unexamined Patent Publication No. H6-281194 discloses an air conditioner including a blowing unit. A turbo fan is housed in a case of the blowing unit. In the blower unit, a rotating shaft of the turbo fan is directed in the up-down direction, an air inflow port is provided in a lower part of the case of the blowing unit, and an air blowout port is provided in an upper part of the case of the blowing unit. Therefore, the air having passed through the heat exchange unit flows into the case from the inflow port in the lower part of the case of the blowing unit and is discharged to the outer side in the radial direction of the turbo fan in the case. The air discharged from the turbo fan in the horizontal direction changes its direction upward in the case and is blown out from the blowout port in the upper part of the case.

In the blowing unit disclosed in Japanese Unexamined Patent Publication No. H6-281194, a wind guide plate arranged to gradually decrease in opening width toward the blowout port is necessary so that the air discharged from the turbo fan in the horizontal direction in the case changes its direction upward and is blown out from the blowout port in the upper part of the case. Therefore, in the blowing unit disclosed in Japanese Unexamined Patent Publication No. H6-281194, the number of components increases and airflow resistance increases.

SUMMARY OF INVENTION

It is an object of the present invention to provide a fan unit and an air conditioner that can smoothly blow out, from a blowout port, the air discharged from a centrifugal fan including backward curved blades and can suppress an increase in the number of components and an increase in airflow resistance.

The fan unit of the present invention is configured to be connected to a heat exchange unit in which a heat exchanger is housed. The fan unit includes a fan case, a partition member, and a centrifugal fan. The fan case has an air inflow port and an air blowout port. The fan case has, in a side section of the fan case on the inflow port side, a unit connecting portion for connecting the heat exchange unit. The partition member partitions an inside of the fan case into an upstream side space on the inflow port side and a downstream side space on the blowout port side. The partition member has an opening for allowing the upstream side space and the downstream side space to communicate with each other. The centrifugal fan includes an impeller including a plurality of backward curved blades. The centrifugal fan is arranged such that the impeller is located in the downstream side space and sucks air in the upstream side space through the opening. The blowout port is located on an outer side in a radial direction of the impeller in the downstream side space.

An air conditioner of the present invention includes a casing, a partition member, a heat exchanger, and a centrifugal fan. The casing has an air suction port and an air blowout port. The partition member partitions an inside of the casing into a first space on the suction port side and a second space on the blowout port side. The partition member has an opening for allowing the first space and the second space to communicate with each other. The heat exchanger is arranged in the first space. The centrifugal fan includes an impeller including a plurality of backward curved blades. The centrifugal fan is arranged such that the impeller is located in the second space and sucks air in the first space through the opening. The blowout port is located on an outer side in a radial direction of the impeller in the second space.

DESCRIPTION OF EMBODIMENTS

Figure 1:
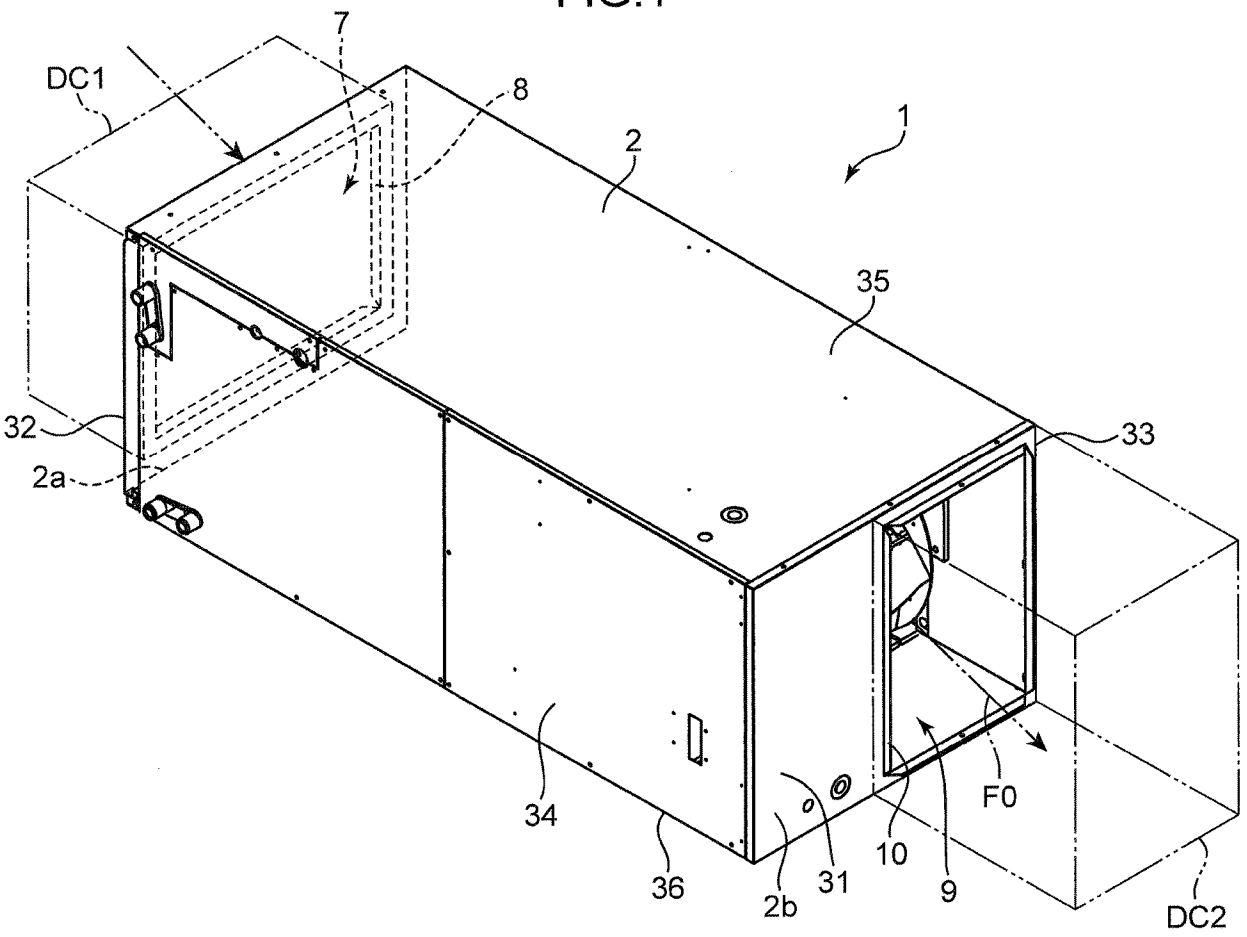
FIG. 1 is a perspective view showing the external appearance of a duct-type indoor unit of an air conditioner according to an embodiment of the present invention.

An air conditioner according to an embodiment of the present invention is explained with reference to the drawings. In this embodiment, a duct-type indoor unit is explained as a specific example of the air conditioner. Further, a fan unit according to an embodiment of the present invention and a heat exchange unit connected to the fan unit are explained. First, the duct-type indoor unit in the embodiment is explained, and the fan unit and the heat exchange unit are explained after the explanation of the duct-type indoor unit.

[Duct-Type Indoor Unit]

A duct-type indoor unit 1 shown in FIGS. 1 to 4 includes a casing 2, a partition member 3 that partitions the inside of the casing 2 into two spaces (i.e., a first space 11 and a second space 12), a pair of heat exchangers 4 housed in the first space 11 (more specifically, a heat exchange chamber 15 of the first space 11), and a centrifugal fan 5 housed in the second space 12. The centrifugal fan 5 includes an impeller 21 and a fan motor 6. The fan motor 6 drives to rotate the impeller 21 of the centrifugal fan 5.

The casing 2 includes a first side section 31 (a rear plate 31), a second side section 32 (a front plate 32), a third side section 33 (a side plate 33), a fourth side section 34 (a side plate 34), a fifth side section 35 (an upper plate 35), and a sixth side section 36 (a lower plate 36). The casing 2 having a long rectangular parallelepiped shape is formed by the side sections 31 to 36. The first side section 31 (the rear plate 31) and the second side section 32 (the front plate 32) are arranged to be spaced apart from each other in the longitudinal direction of the casing 2 (a direction of an arrow X in FIGS. 2 to 4). The fifth side section 35 (the upper plate 35) and the sixth side section 36 (the lower plate 36) are arranged to be spaced apart from each other in the up-down direction (a direction of an arrow Z in FIGS. 2 and 4) orthogonal to the longitudinal direction of the casing 2. The third side section 33 (the side plate 33) and the fourth side section 34 (the side plate 34) are arranged to be spaced apart from each other in a width direction Y of the casing 2 orthogonal to the longitudinal direction of the casing 2.

Figure 2:
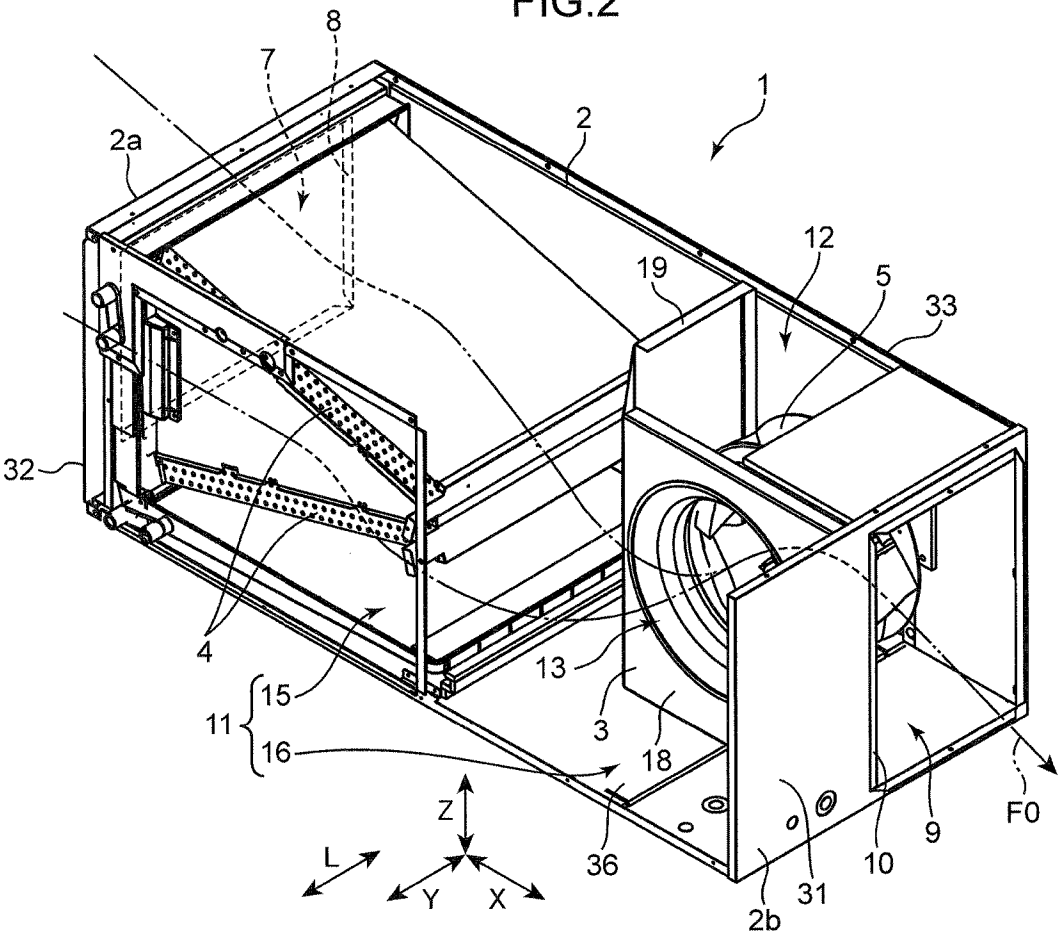
FIG. 2 is a cutout perspective view showing the internal structure of the duct-type indoor unit shown in FIG. 1.
Figure 3:
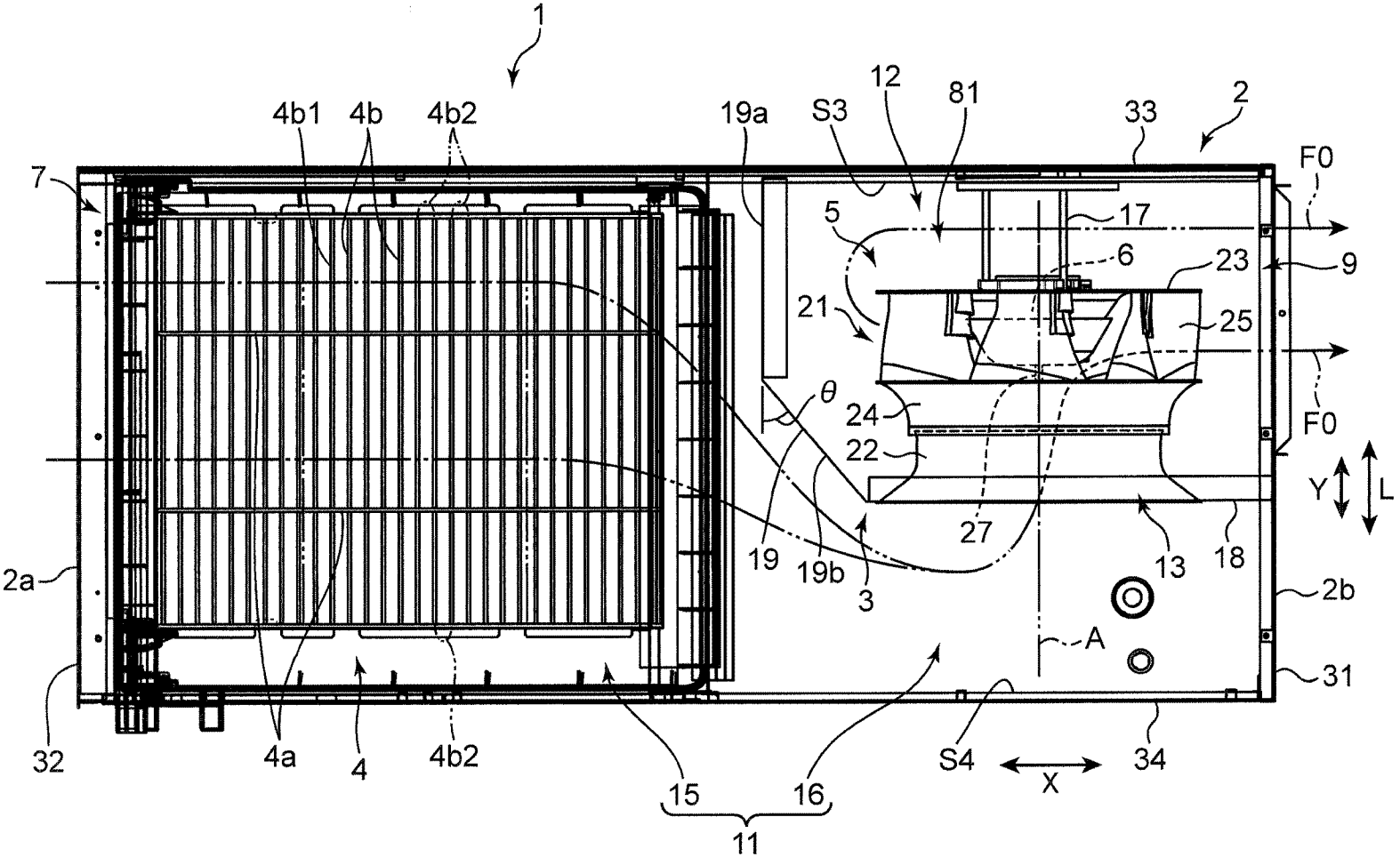
FIG. 3 is a top plan view of the duct-type indoor unit shown in FIG. 2.

As shown in FIGS. 2 and 3, an axial direction A of a rotating shaft 27 for rotating the impeller 21 extends in parallel to the width direction Y of the casing 2. The direction X and the direction Y are orthogonal to each other. The direction X and the direction Z are orthogonal to each other. The direction Y and the direction Z are orthogonal to each other. In this embodiment, as shown in FIGS. 2 and 3, the width direction Y of the casing coincides with the direction of an imaginary straight line L. That is, the axial direction A of the rotating shaft 27 for rotating the impeller 21 is parallel to the imaginary straight line L. In this embodiment, the first side section 31 and the second side section 32 are parallel to the imaginary straight line L. The third side section 33 and the fourth side section 34 are perpendicular to the imaginary straight line L. The fifth side section 35 and the sixth side section 36 are parallel to the imaginary straight line L.

The casing 2 has a pair of surfaces formed by the first side section 31 (the rear plate 31) and the second side section 32 (the front plate 32) and opposed to each other in the front-back direction, that is, an upstream side surface 2*a* and a downstream side surface 2*b*. The upstream side surface 2*a* has a suction port 7 and a suction-duct connecting portion 8 that forms the outer edge of the suction port 7 and to which a suction duct DC1 is connected (see FIG. 1). The downstream side surface 2*b* has a blowout port 9 and a blowout-duct connecting portion 10 that forms the outer edge of the blowout port 9 and to which a blowout duct DC2 is connected (see FIG. 1).

Figure 5:
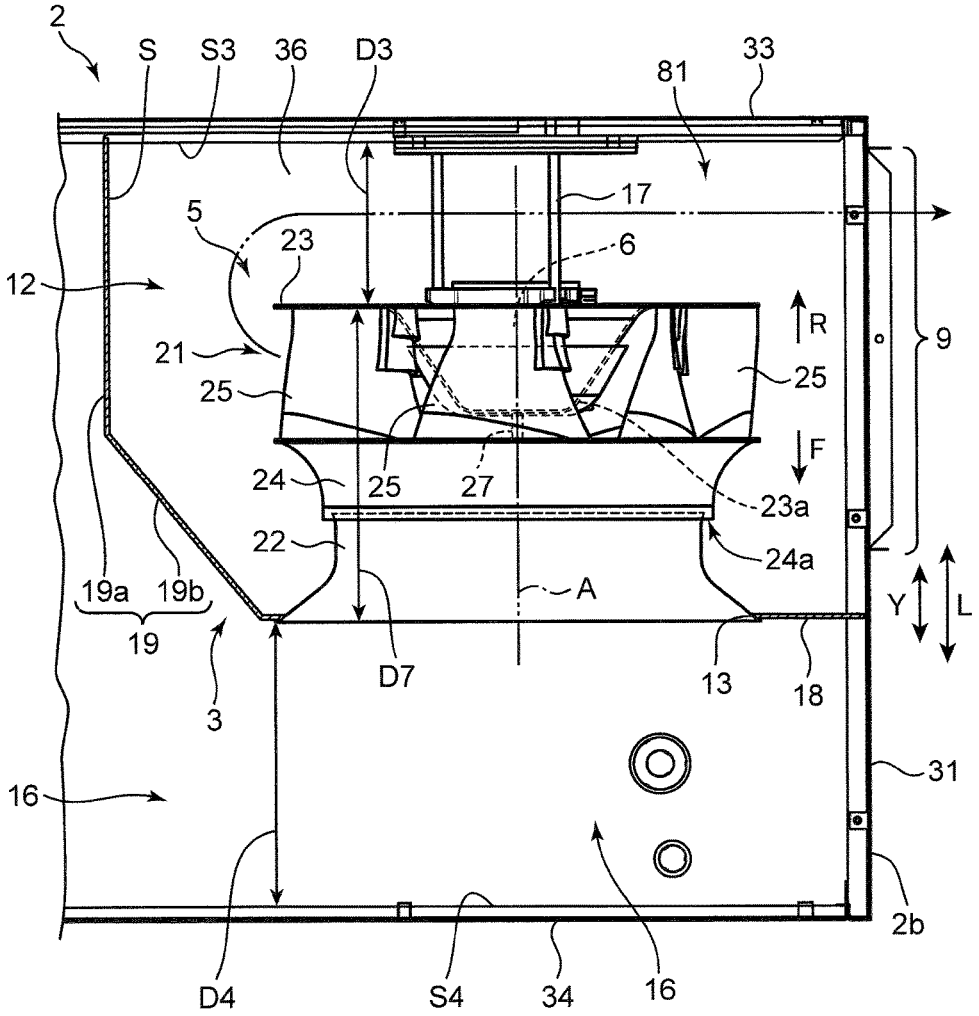
FIG. 5 is an enlarged view of a partition member and the inside of a second space shown in FIG. 3.
Figure 6:
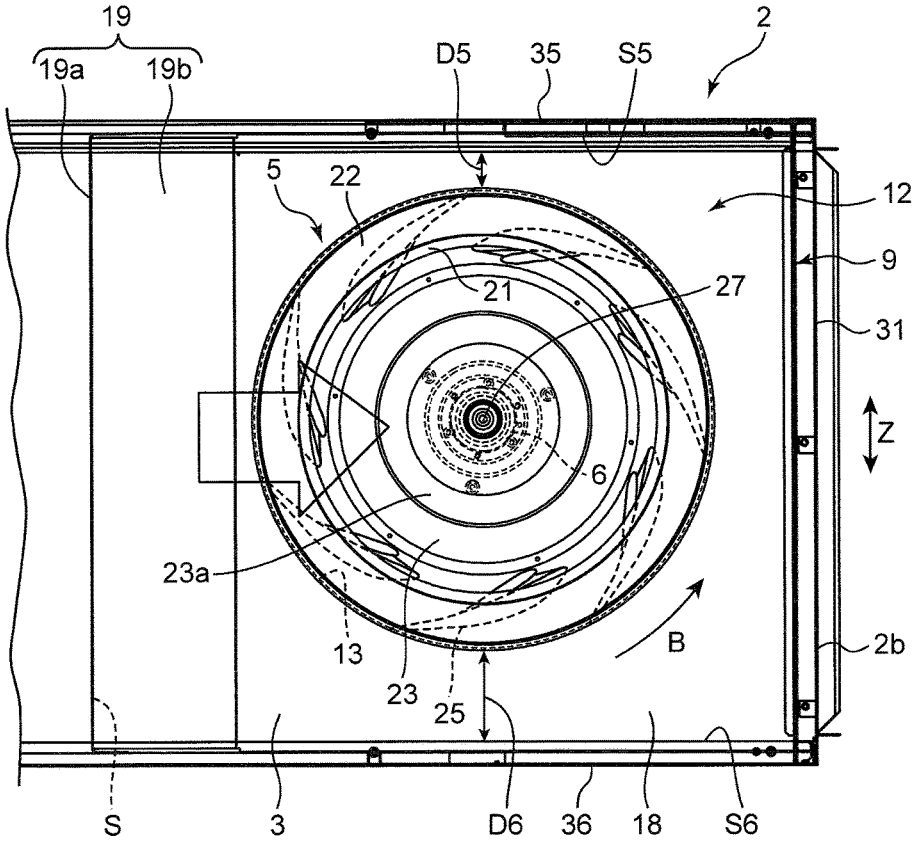
FIG. 6 is an enlarged view of the partition member and a centrifugal fan shown in FIG. 4.

In this embodiment, each of the third side section 33, the fourth side section 34, the fifth side section 35, and the sixth side section 36 forms a sidewall without an opening formed therein. As shown in FIGS. 5 and 6, the third side section 33 has an inner surface S3 (a hub side inner surface S3). The fourth side section 34 has an inner surface S4 (an opening side inner surface S4). The fifth side section 35 has an inner surface S5 (an upstream side inner surface S5). The sixth side section 36 has an inner surface S6 (a downstream side inner surface S6). The partition member 3 has an inner surface S (a partition inner surface S).

The blowout-duct connecting portion 10 shown in FIGS. 1 and 2 includes, for example, a plurality of ridges that project to the downstream side of an air flow F0 from the downstream side surface 2*b* in such a way as to surround the blowout port 9. The blowout duct DC2 is fixed to the ridges by screwing or the like in a state in which the blowout duct DC2 is laid on the ridges. The suction-duct connecting portion 8 has a configuration same as the configuration of the blowout-duct connecting portion 10.

Note that, in the present invention, the suction duct DC1 and the blowout duct DC2 are not particularly limited as long as the suction duct DC1 and the blowout duct DC2 are tubular bodies that can respectively communicate with the suction port 7 and the blowout port 9. Square tubes and tubular bodies having other various shapes can be adopted. The suction-duct connecting portion 8 and the blowout-duct connecting portion 10 only have to be configured such that the suction duct DC1 and the blowout duct DC2 can be respectively connected thereto. Therefore, in the present invention, the structures of the suction-duct connecting portion 8 and the blowout-duct connecting portion 10 are not particularly limited.

The partition member 3 partitions the inside of the casing 2 into the first space 11 on the suction port 7 side and the second space 12 on the blowout port 9 side. The suction port 7 is opened in the first space 11. The blowout port 9 is opened in the second space 12.

Specifically, as shown in FIGS. 3 to 6, the partition member (the partition plate) 3 includes a first portion 18 (a first partition plate 18) and a second portion 19 (a second partition plate 19) that is contiguous to the first portion 18.

The first portion 18 is a flat portion and extends perpendicularly to the rotating shaft 27 for rotating the impeller 21 and extends perpendicularly to the upstream side surface 2*a*. That is, the first portion 18 extends in parallel to the longitudinal direction X of the casing 2.

The first portion 18 partitions the second space 12 and the first space 11 (specifically, an airflow passage 16 of the first space 11 explained below). In the first portion 18, an opening 13 for allowing the second space 12 and the airflow passage 16 of the first space 11 to communicate with each other is formed. That is, the first space 11 and the second space 12 communicate with each other through the opening 13.

The second portion 19 is a portion that is contiguous to the first portion 18 and is a portion that partitions the second space 12 and an arrangement space for heat exchangers 4 in the first space 11 (specifically, a heat exchange chamber 15 explained below). Specifically, the second portion 19 includes a parallel portion 19*a* extending in parallel to the axial direction A of the rotating shaft 27 and an inclined portion 19*b* inclined toward the opening 13 side of the first portion 18 with respect to the axial direction A of the rotating shaft 27. One end of the inclined portion 19*b* is connected to an end of the first partition plate 18 on the suction port 7 side (the heat exchangers 4 side). The other end of the inclined portion 19*h* is located further on the impeller 21 side (the third side section 33 side) than the first partition plate 18 in the axial direction A of the rotating shaft 27. The other end of the inclined portion 19*b* is connected to the parallel portion 19*a*.

An inclination angle θ (see FIG. 3) of the inclined portion 19*b* with respect to the axial direction A is set to be an angle at which the air in the heat exchange chamber 15 is smoothly guided to the opening 13. Consequently, it is possible to suppress occurrence of a turbulent flow near the inclined portion 19*b*. As shown in FIGS. 3 and 5, a space surrounded by a shroud 24 and a bell mouth 22 explained below and the partition member 3 is a space that tends to be a dead space. Therefore, since the dead space can be reduced by providing the inclined portion 19*b*, it is possible to effectively use a space.

Since the parallel portion 19*a* is present, it is possible to limit an amount of projection of the inclined portion 19*b* toward the heat exchange chamber 15 side and it is therefore possible to secure a space of the heat exchange chamber 15. Moreover, it is possible to guide the blowout air of the centrifugal fan 5 housed in the second space 12 to the blowout port 9 side. Note that the parallel portion 19*a* can be omitted.

As shown in FIG. 5, both ends of the partition member 3 are respectively connected to inner walls of the casing 2.

That is, the parallel portion 19*a* of the second portion 19 of the partition member 3 is connected to the third side section 33. The first portion 18 of the partition member 3 is connected to the first side section 31.

Figure 4:
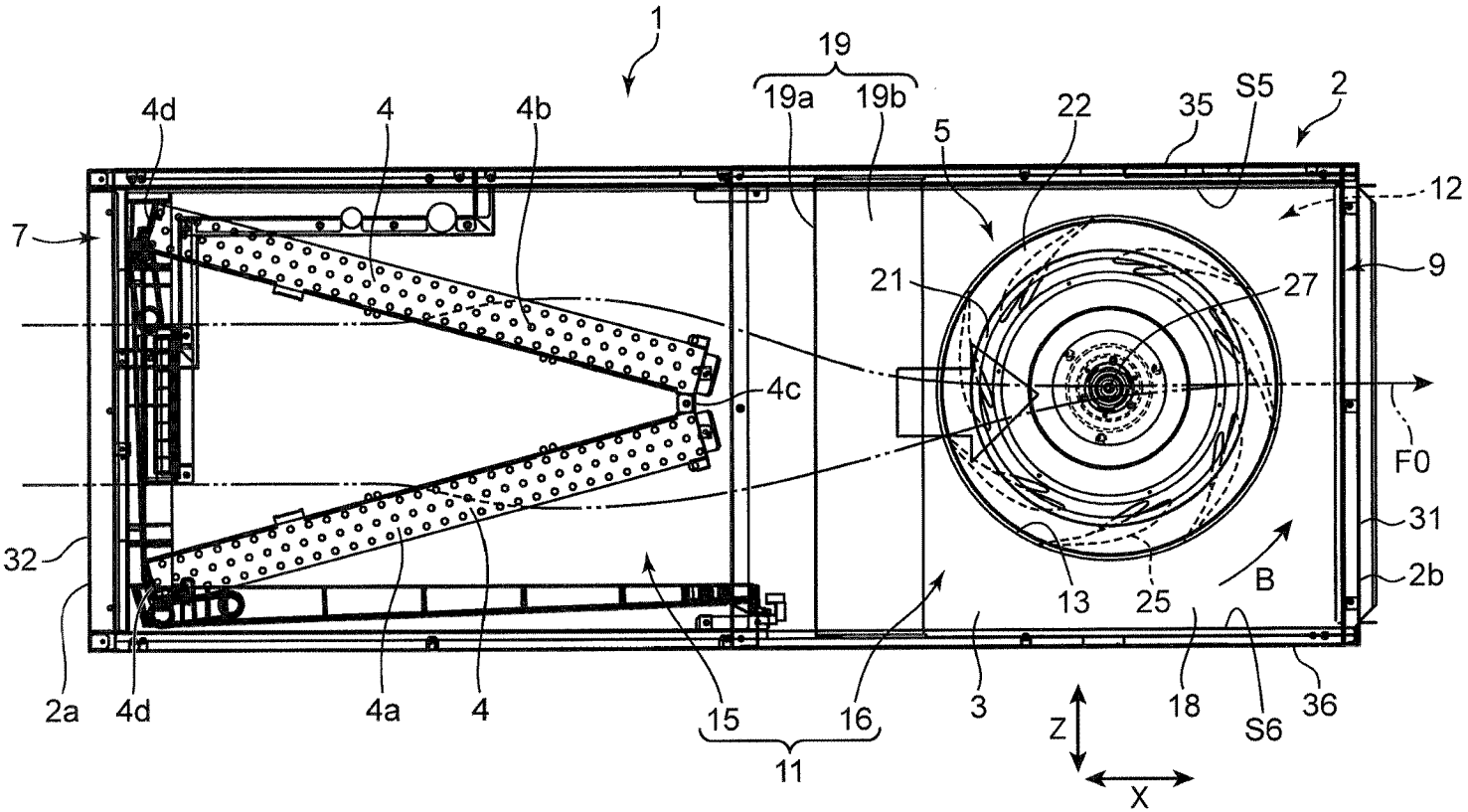
FIG. 4 is a front view of the duct-type indoor unit shown in FIG. 2.

As shown in FIGS. 3 to 5, the first space 11 includes the heat exchange chamber 15 in which the heat exchangers 4 are housed and the airflow passage 16 on the downstream side of the heat exchange chamber 15. The airflow passage 16 is formed between the first portion 18 and the inner surface S4 (the opening side inner surface S4) of the fourth side section 34 of the casing 2 opposed to the first portion 18. The airflow passage 16 is a space extending in parallel to the first portion 18 and guides the air having passed through the heat exchangers 4 housed in the heat exchange chamber 15 to the opening 13.

In a relation between the airflow passage 16 and the second space 12, the airflow passage 16 is an upstream side space 16 and the second space 12 is a downstream side space 12.

In the second space 12 (the downstream side space 12), as shown in FIGS. 3 and 5, the centrifugal fan 5 is housed sideways such that the axial direction A of the rotating shaft 27 for rotating the impeller 21 is parallel to each of the upstream side surface 2*a* and the downstream side surface 2*b*. In such sideway arrangement of the centrifugal fan 5, the blowout port 9 of the casing 2 is located on the outer side in the radial direction of the impeller 21. In the second space 12, the fan motor 6 is housed sideways to be coaxial with the impeller 21. The fan motor 6 is fixed to the third side section 33 of the casing 2 via a support stand 17. Note that the fan motor 6 may be directly fixed to the casing 2.

The centrifugal fan 5 is a turbo fan. The centrifugal fan 5 includes the impeller 21 and the bell mouth 22. The centrifugal fan 5 is located in the second space 12 and sucks the air in the first space 11 through the opening 13.

As shown in FIGS. 5 to 6, the impeller 21 includes a hub 23, the shroud 24, and a plurality of blades 25 arranged between the hub 23 and the shroud 24. The hub 23 includes, in the center thereof, a projecting section 23*a* that projects to the shroud 24 side. The projecting section 23*a* is fixed to the rotating shaft 27 of the fan motor 6. The rotating shaft 27 functions as the rotating shaft 27 in order to rotate the impeller 21.

The shroud 24 is arranged on a front side F of the rotating shaft 27 in the axial direction A so as to be opposed to the hub 23. The shroud 24 has an air suction port 24*a* circularly opened centering on the rotating shaft 27. The outer diameter of the shroud 24 increases toward a rear side R.

The plurality of blades 25 are arrayed at a predetermined interval along the circumferential direction of the rotating shaft 27 between the hub 23 and the shroud 24. Ends on the front side F of the blades 25 are joined to the inner surface of the shroud 24. Ends on the rear side R of the blades 25 are joined to the hub 23. The blades 25 are backward curved blades (backward oriented blades) inclined in the opposite direction (a backward direction) of a rotating direction B (see FIG. 6) with respect to the radial direction of the hub 23.

The bell mouth 22 is arranged on the front side F in the axial direction A so as to be opposed to the shroud 24. An end on the front side F of the bell mouth 22 is arranged to coincide with the edge of the opening 13 of the first portion 18 of the partition member 3. The bell mouth 22 has a curved shape, the outer diameter of which decreases toward the rear side R.

As shown in FIGS. 3 and 5, an air guide passage 81 is provided between the hub 23 and the inner surface S3 (the hub side inner surface S3) of the third side section 33. The air guide passage 81 guides, to the blowout port 9 side, a part of the air discharged in a direction different from the blowout port 9 side, out of the air discharged from the impeller 21. The air guide passage 81 functions as an air flow returning section 81 that returns, to the blowout port 9 side, a part of the air discharged in the direction different from the blowout port 9 side, out of the air discharged from the impeller 21.

Specifically, in FIG. 6, the air guide passage 81 guides, to the blowout port 9 side as indicated by an arrow of an alternate long and two short dashes line in FIG. 5, the air discharged from the impeller 21 toward the inner surface S5 side of the fifth side section 35, the air discharged from the impeller 21 toward the second partition plate 19 side, and the like. Consequently, the air discharged from the impeller 21 to the outer side in the radial direction can not only flow in the circumferential direction in an air passage around the impeller 21 in the downstream side space 12 but also flow toward the blowout port 9 through the air guide passage 81 between the hub 23 and the inner surface S3 of the third side section 33. Therefore, it is possible to reduce airflow resistance in the downstream side space 12.

As shown in FIG. 5, a distance D4 between the inner surface S4 of the fourth side section 34 and the peripheral edge portion of the opening 13 is larger than a distance D3 between the inner surface S3 of the third side section 33 and the hub 23. An amount of the air flowing into the impeller 21 through the opening 13 is larger than an amount of the air passing through the air guide passage 81 between the hub 23 and the inner surface S3 of the third side section 33. Therefore, when the distance D4 is larger than the distance D3, the amount of the air and the size of the passage can be well balanced. Consequently, it is possible to further reduce the airflow resistance.

A total distance of a distance D7 from the hub 23 to the peripheral edge portion of the opening 13 and the distance D3 is preferably larger than the distance D4. Consequently, since the capacity of the downstream side space 12 can be sufficiently secured, it is possible to suppress the airflow resistance from increasing in the downstream side space 12. The total distance of the distance D3 and the distance D7 is a partition height of the upstream side space 16 (the airflow passage 16) and the downstream side space 12 partitioned in the width direction Y of the casing 2 by the partition member 3.

As shown in FIG. 6, the impeller 21 rotates in the rotating direction B in which the blades 25 are opposed to the upstream side inner surface S5 of the fifth side section 35, the inner surface S (the partition inner surface S) of the second partition plate 19 of the partition member 3, the downstream side inner surface S6 of the sixth side section 36, and the blowout port 9 in this order. That is, the upstream side inner surface S5, the partition inner surface S, the downstream side inner surface S6, and the blowout port 9 are provided side by side in this order in the rotating direction B of the impeller 21. The upstream side inner surface S5, the partition inner surface S, and the downstream side inner surface S6 surround the circumference of the impeller 21 excluding an area of the blowout port 9.

A distance D6 between the inner surface S6 (the downstream side inner surface S6) of the sixth side section 36 and the impeller 21 is larger than a distance D5 between the inner surface S5 (the upstream side inner surface S5) of the fifth side section 35 and the impeller 21. That is, in the second space 12, the rotation center of the impeller 21 (the center of the rotating shaft 27) is present in a position further deviating to the inner surface S5 side than the center between the inner surface S5 and the inner surface S6. Since the distance D6 is larger than the distance D5, it is possible to efficiently convert a dynamic pressure obtained by the rotation of the impeller 21 into a static pressure.

The centrifugal fan 5 explained above is housed in the second space 12 of the casing 2. Consequently, the air blown out from the impeller 21 is guided to the blowout port 9 by members surrounding the outer side in the radial direction of the impeller 21, that is, the second portion 19 of the partition member 3 and the fifth side section 35 (the upper plate 35), the sixth side section 36 (the lower plate 36), and the third side section 33 of the casing 2. In other words, the second portion 19 of the partition member 3 and the fifth side section 35 (the upper plate 35), the sixth side section 36 (the lower plate 36), and the third side section 33 of the casing 2 function as a fan casing of the centrifugal fan 5. Therefore, a fan casing is unnecessary in the centrifugal fan 5 itself.

As shown in FIG. 4, the pair of heat exchangers 4 is arranged in the heat exchange chamber 15 of the first space 11 of the casing 2, in a V shape in side view to be further spaced away from each other in the up-down direction Z (i.e., the vertical direction) of the casing 2 toward the suction port 7 of the casing 2.

Further, as shown in FIG. 4, the pair of heat exchangers 4 is arranged such that an edge 4*c* forming the vertex of the V shape in the heat exchangers 4 is parallel to the rotating shaft 27 of the impeller 21. Further, edges 4*d* on the upstream side surface 2*a* side in the pair of heat exchangers 4 are also arranged in parallel to the rotating shaft 27. The edges 4*d* extend along the edge of the suction port 7 of the casing 2. All of the edges 4*c* and 4*d* of the heat exchangers 4 extend in a direction orthogonal to the first portion 18 of the partition member 3.

Specifically, as shown in FIGS. 3 to 4, the heat exchangers 4 include a large number of fins 4*a* arranged to be spaced apart from one another and a plurality of heat transfer tubes 4*b* that pierce through the fins 4*a*. The heat transfer tubes 4*b* include a plurality of straight tube portions 4*b*1 extending linearly and U-shape tube portions 4*b*2, which are end communication sections that allow ends of the straight tube portions 4*b*1 to communicate with each other. Note that, in FIG. 3, the fins 4*a* are shown in a smaller number such that the heat transfer tubes 4*b* are easily visually recognized.

The straight tube portions 4*b*1 extend along a surface parallel to a plane including the rotating shaft 27. Specifically, the straight tube portions 4*b*1 of the heat transfer tubes 4*b* are parallel to the axial direction A of the rotating shaft 27. The plurality of straight tube portions 4*b*1 are arranged to be parallel to each other. Ends of the heat transfer tubes 4*b* adjacent to each other are connected to each other via the U-shape tube portion 4*b*2. The heat exchangers 4 have a plurality of paths (refrigerant channels). The fins 4*a* are joined by, for example, brazing to the straight tube portions 4*b*1 of the heat transfer tubes 4*b* in a state in which the fins 4*a* are spaced apart from one another. In the heat exchangers 4, heat exchange is performed between the refrigerant passing through the heat transfer tubes 4*b* and the air around the fins 4*a*.

In the duct-type indoor unit 1 configured as explained above, as shown in FIG. 1, the suction duct DC 1 is connected to the suction-duct connecting portion 8 of the casing 2 and the blowout duct DC2 is connected to the blowout-duct connecting portion 10. In that state, the impeller 21 of the centrifugal fan 5 rotates by the driving of the fan motor 6. Consequently, as shown in FIGS. 2 to 4, it is possible to generate a series of air flows F0 that flow from the suction duct DC1 to the blowout duct DC2 through the duct-type indoor unit 1.

In this case, the air flows through a route explained below inside the casing 2 of the duct-type indoor unit 1. First, the air sucked into the inside of the casing 2 from the suction duct DC 1 through the suction port 7 passes through the heat exchangers 4 in the heat exchange chamber 15 of the first space 11. Consequently, the air is subjected to heat exchange with the refrigerant when the air passes through the heat exchangers 4 and cooled or heated. Thereafter, the air subjected to the heat exchange is once collected in the airflow passage 16 of the first space 11 and rectified in the longitudinal direction X of the casing 2. In this case, a part of the air subjected to the heat exchange is guided to the airflow passage 16 by the inclined portion 19*b* of the second portion 19 of the partition member 3 when the air flows from the heat exchange chamber 15 to the airflow passage 16.

Thereafter, the air reaching the airflow passage 16 is introduced into the second space 12 through the opening 13 of the first portion 18 of the partition member 3. The air introduced into the second space 12 flows to the impeller 21 through the inside of the bell mouth 22 of the centrifugal fan 5. The air reaching the impeller 21 is blown out to the outer side in the radial direction of the impeller 21. The air blown out from the impeller 21 smoothly flows from the casing 2 to the blowout duct DC2 through the blowout port 9 located on the outer side in the radial direction of the impeller 21.

As explained above, in the duct-type indoor unit 1 in this embodiment, the centrifugal fan 5 is adopted. Therefore, unlike a multiblade fan that has been used in a duct-type indoor unit in the past, a fan casing is unnecessary. It is possible to reduce the number of components and reduce a setting space for the fan. Since the centrifugal fan 5 is used, compared with the multiblade fan, fan efficiency is improved. It is possible to reduce fan power while securing a necessary static pressure and a necessary amount of the air.

Further, in the duct-type indoor unit 1, the suction-duct connecting portion 8 and the blowout-duct connecting portion 10 are arranged on the upstream side surface 2*a* and the downstream side surface 2*b* of the casing 2 opposed to each other. Therefore, it is possible to linearly arrange the suction duct DC1 and the blowout duct DC2.

Moreover, the rotating shaft 27 of the impeller 21 is parallel to the upstream side surface 2*a* on which the suction-duct connecting portion 8 is formed. Therefore, it is easy to secure a channel that guides the air sucked from the suction port 7 formed on the upstream side surface 2*a* to the opening 13.

In the duct-type indoor unit 1, the suction port 7, the heat exchangers 4, the centrifugal fan 5, and the blowout port 9 are arranged in a row in a direction (in this embodiment, the X direction) orthogonal to the axial direction A of the impeller 21. Since the suction port 7, the heat exchangers 4, the centrifugal fan 5, and the blowout port 9 are linearly arrayed in the X direction, it is possible to reduce the dimension in the width direction Y and the dimension in the height direction Z of the casing 2. In this configuration, as shown in FIG. 1, it is possible to linearly arrange the suction duct DC 1 and the blowout duct DC2 along the above array direction (the X direction).

In the duct-type indoor unit 1 in this embodiment, the straight tube portions 4*b*1 of the heat transfer tubes 4*b* in the heat exchangers 4 extend along a surface parallel to a plane including the rotating shaft 27. Therefore, the air introduced into the inside of the casing 2 from the suction port 7 formed on the upstream side surface 2*a* parallel to the rotating shaft 27 can flow while being in contact with the all straight tube portions 4*b*1 of the heat transfer tubes 4*b* when the air passes through the heat exchangers 4. Therefore, even if velocity distribution of the air flows F0 passing through the heat exchangers 4 fluctuates in the direction of the rotating shaft 27 (the Y direction), it is possible to uniformly cool or heat the plurality of heat transfer tubes 4*b* with the air. Therefore, even in a structure in which the plurality of heat transfer tubes 4*b* form a plurality of paths and the refrigerant flows to the paths, it is possible to suppress a difference in cooling or heating performance of the refrigerant among the paths from increasing.

In the duct-type indoor unit 1 in this embodiment, the airflow passage 16 is formed between the first portion 18 extending perpendicularly to the rotating shaft 27 in the partition member 3 and the inner surface S4 of the fourth side section 34 of the casing 2 opposed to the first portion 18. Therefore, it is possible to secure the airflow passage 16 wide. It is possible to smoothly guide, with the airflow passage 16, the air having passed through the heat exchangers 4 to the opening 13 while rectifying the air.

In the duct-type indoor unit 1 in this embodiment, the second portion 19 of the partition member 3 that partitions the second space 12, in which the centrifugal fan 5 is housed, and the heat exchange chamber 15, which is the arrangement space for the heat exchangers 4, includes the inclined portion 19*b* inclined toward the opening 13 side of the first portion 18 with respect to the direction of the rotating shaft 27. Therefore, the air flowing out from the heat exchange chamber 15 flows along the inclined portion 19*b* to be smoothly guided to the airflow passage 16.

In the duct-type indoor unit 1 in this embodiment, the pair of heat exchangers 4 is arranged so as to open in the V shape in section to be further spaced away from each other in the up-down direction Z of the casing 2 toward the suction port 7 of the casing 2. In this configuration, compared with when the heat exchangers 4 are arranged parallel to the surface on which the suction port 7 is formed, it is possible to house the heat exchangers 4 having a wider area in the first space 11 of the casing 2. Since the heat exchangers 4 are arranged in the V cross-sectional shape opening toward the suction port 7, it is possible to introduce the air into the first space 11 from the entire suction port 7. Moreover, the air introduced into the first space 11 from the suction port 7 can uniformly pass through the entire heat exchangers 4.

In the duct-type indoor unit 1 in this embodiment, the edge 4*c* forming the vertex of the V shape in the heat exchangers 4 is parallel to the rotating shaft 27 of the impeller 21. Therefore, it is possible to reduce deviation of the air passing through the heat exchangers 4 while securing the area of the heat exchangers 4.

In the duct-type indoor unit 1 in this embodiment, the rotating shaft 27 of the impeller 21 of the centrifugal fan 5 is parallel to the downstream side surface 2*b* of the casing 2 in which the blowout-duct connecting portion 10 is formed. In such a configuration, since the blowout port 9 of the casing 2 is located on the outer side in the radial direction of the impeller 21, it is possible to smoothly blow out, from the blowout port 9, the air blown out to the outer side in the radial direction from the impeller 21. Therefore, in forming an air flow in one direction flowing to the blowout duct DC2, it is possible to suppress the airflow resistance even if a member such as a guide plate for guiding the air flow from the impeller 21 to the blowout port 9 is not provided.

In the duct-type indoor unit 1 in this embodiment, the blowout port 9 is located on the outer side in the radial direction of the impeller 21 in the second space 12. Therefore, it is possible to smoothly blow out, from the blowout port 9, the air discharged from the impeller 21. Therefore, in this configuration, since the wind guide plate described in Japanese Unexamined Patent Publication No. H6-281194 is unnecessary, it is possible to suppress an increase in the airflow resistance while suppressing an increase in the number of components.

In the duct-type indoor unit 1 in this embodiment, the impeller 21 includes the shroud 24 located on the opening 13 side in the radial direction A of the rotating shaft 27 for rotating the impeller 21 and the hub 23 located on the opposite side to the shroud 24 in the axial direction A. The casing 2 has the hub side inner surface S3 present in the position on the opposite side to the opening 13 with respect to the impeller 21 in the axial direction A and opposed to the hub 23 in the axial direction A. The air guide passage 81 is provided between the hub 23 and the hub side inner surface S3. The air guide passage 81 that guides, to the blowout port 9 side, a part of the air discharged in the direction different from the blowout port 9 side, out of the air discharged from the impeller 21. Therefore, it is possible to reduce the airflow resistance in the second space 12.

In the duct-type indoor unit 1 in this embodiment, the casing 2 has the opening side inner surface S4 present in the position on the opposite side to the hub side inner surface S3 with respect to the impeller 21 and the opening 13 in the axial direction A and opposed to the opening 13 in the axial direction A. The distance D4 between the opening side inner surface S4 and the peripheral edge portion of the opening 13 is larger than the distance D3 between the hub side inner surface S3 and the hub 23. An amount of the air flowing into the impeller 21 through the opening 13 is larger than an amount of the air passing through the air guide passage 81 between the hub 23 and the hub side inner surface S3. Therefore, as in this embodiment, when the distance D4 between the opening side inner surface S4 and the peripheral edge portion of the opening 13 is larger than the distance D3 between the hub side inner surface S3 and the hub 23, the amount of the air and the size of the passage can be well balanced. Consequently, it is possible to further reduce the airflow resistance.

In the duct-type indoor unit 1 in this embodiment, the casing 2 has the upstream side inner surface S5 and the downstream side inner surface S6 located on the outer side in the radial direction with respect to the impeller 21. The upstream side inner surface S5 is located on the opposite side to the downstream side inner surface S6 with respect to the impeller 21 in the radial direction. The partition member 3 has the partition inner surface S located on the outer side in the radial direction with respect to the impeller 21. The partition inner surface S is present in the position on the opposite side to the blowout port 9 with respect to the impeller 21 in the radial direction. The upstream side inner surface S5, the partition inner surface S, and the downstream side inner surface S6 are provided side by side in this order in the rotating direction B of the impeller 21. The distance D6 between the downstream side inner surface S6 and the impeller 21 is larger than the distance D5 between the upstream side inner surface S5 and the impeller 21. Therefore, it is possible to efficiently convert a dynamic pressure obtained by the rotation of the impeller 21 into a static pressure.

In the duct-type indoor unit 1 in this embodiment, the partition member 3 includes the first partition plate 18 that is provided in the position opposed to the impeller 21 in the axial direction A of the rotating shaft 27 and in which the opening 13 is formed and the second partition plate 19 that is provided on the suction port 7 side with respect to the impeller 21 and closes the suction port 7 side in the second space 12. The second partition plate 19 includes the inclined portion 19*b* inclined toward the first partition plate 18 side with respect to the axial direction A. One end of the inclined portion 19*b* is connected to the end on the suction port 7 side in the first partition plate 18. The other end of the inclined portion 19*b* is located further on the impeller 21 side than the first partition plate 18 in the axial direction A. Therefore, in this configuration, since the air having passed through the heat exchangers 4 is smoothly guided to the opening 13 side along the inclined portion 19*b*, it is possible to reduce the airflow resistance.

[Fan Unit and Heat Exchange Unit]

A fan unit 1A according to the embodiment of the present invention and a heat exchange unit 1B connected to the fan unit 1A are explained.

Figure 8A:
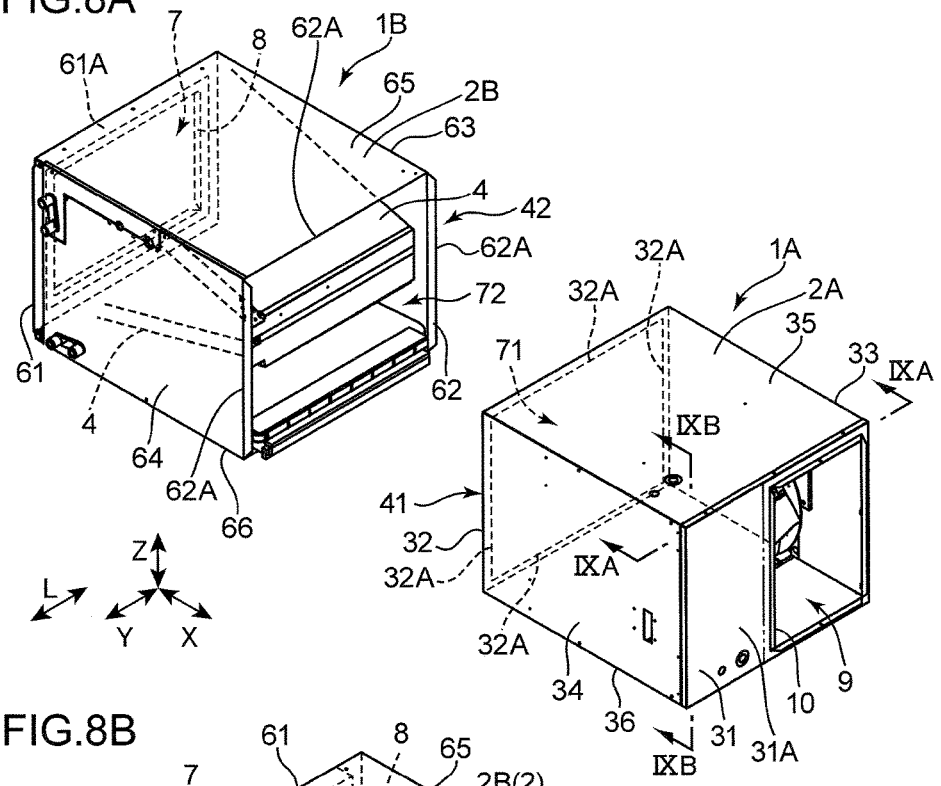
FIG. 8A is a perspective view showing a fan unit according to an embodiment of the present invention and a heat exchange unit connected to the fan unit.
Figure 8B:
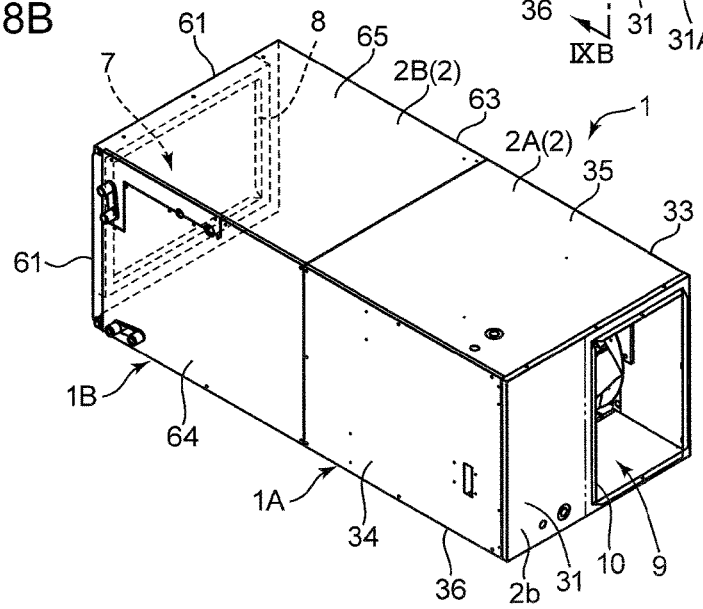
FIG. 8B is a perspective view showing a state in which the fan unit and the heat exchange unit are coupled to each other.
Figure 9A:
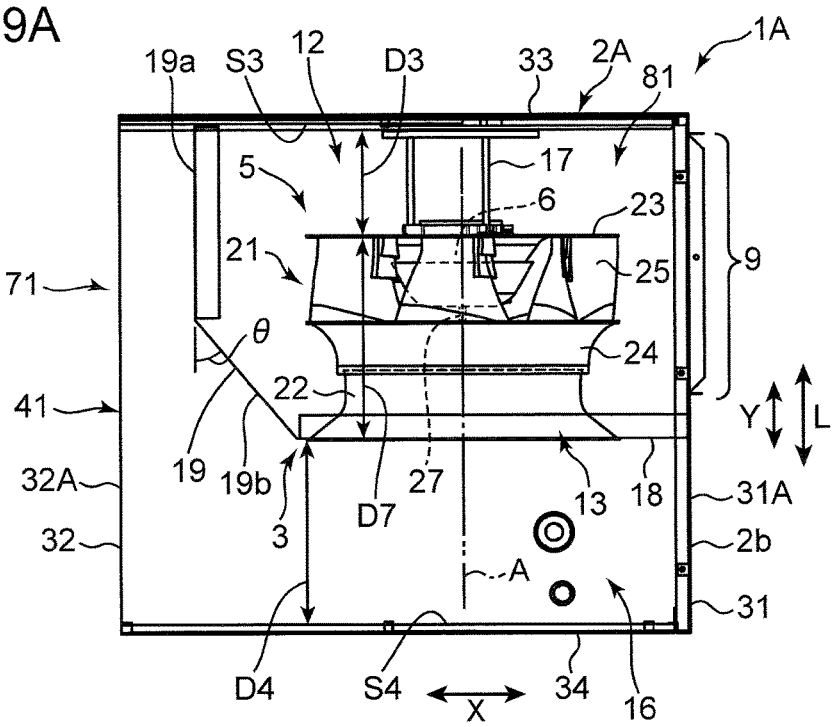
FIG. 9A is an IXA-IXA line sectional view of the fan unit shown in FIG. 8A.
Figure 9B:
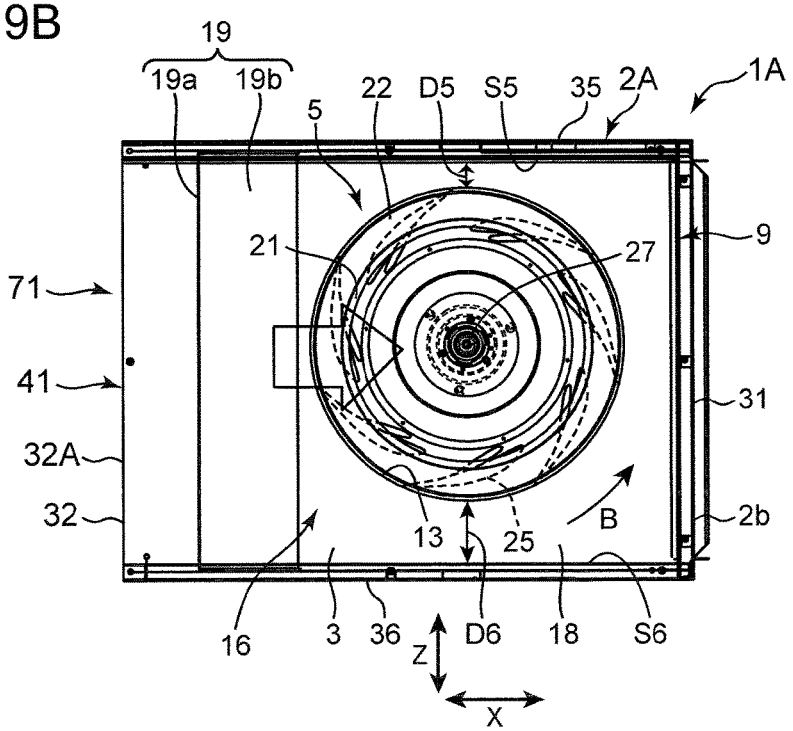
FIG. 9B is an IXB-IXB line sectional view of the fan unit shown in FIG. 8A.

FIG. 8A is a perspective view of the fan unit 1A according to the embodiment of the present invention and the heat exchange unit 1B connected to the fan unit 1A. FIG. 8B is a perspective view showing a state in which the fan unit 1A and the heat exchange unit 1B are coupled to each other. FIG. 9A is an IXA-IXA line sectional view of the fan unit shown in FIG. 8A. FIG. 9B is an IXB-IXB line sectional view of the fan unit shown in FIG. 8A.

The fan unit 1A and the heat exchange unit 1B shown in FIG. 8A are separately assembled and then coupled to each other. The fan unit 1A and the heat exchange unit 1B coupled to each other configures the duct-type indoor unit 1 shown in FIG. 8B. The fan unit 1A in this embodiment can also be sold in the market as a fan unit alone. The fan unit 1A is coupled to the heat exchange unit 1B already set or set anew.

As shown in FIGS. 8A and 8B and FIGS. 9A and 9B, the fan unit 1A includes the partition member 3, the centrifugal fan 5, and a fan case 2A that houses the partition member 3 and the centrifugal fan 5. As shown in FIG. 8A, a heat exchange unit 1B includes the heat exchanger 4 and a heat exchanger case 2B that houses the heat exchanger 4. The fan case 2A and the heat exchanger case 2B are coupled to each other to configure the casing 2 of the duct-type indoor unit 1.

The duct-type indoor unit 1 shown in FIGS. 8A and 8B configured by the fan unit 1A in this embodiment and the heat exchange unit 1B connected to the fan unit 1A has a configuration same as the configuration of the duct-type indoor unit 1 shown in FIGS. 1 to 6 except that the fan unit 1A and the heat exchange unit 1B are detachably attachable to each other. Therefore, concerning the internal structure of the duct-type indoor unit 1 shown in FIGS. 8A and 8B, detailed explanation is omitted. Only main characteristics of the fan unit 1A in this embodiment and the heat exchange unit 1B connected to the fan unit 1A are briefly explained below.

Each of the fan case 2A and the heat exchanger case 2B has a rectangular parallelepiped shape. The fan case 2A includes the first side section 31 to the sixth side section 36 present in positions corresponding to the six surfaces of the rectangular parallelepiped. In the fan case 2A, the blowout port 9 is formed in the first side section 31 among the six side sections. An inflow port 71 is formed in the second side section 32 present in a position opposed to the first side section 31. In this embodiment, each of the third side section 33, the fourth side section 34, the fifth side section 35, and the sixth side section 36 forms a sidewall without an opening formed therein.

In this embodiment, the inflow port 71 is formed by opening almost the entire second side section 32. That is, the inflow port 71 is defined by an edge portion 32A of the second side section 32. The blowout port 9 is formed by opening a part of the first side section 31. Therefore, the first side section 31 includes a flat portion 31A and the blowout port 9. As shown in FIG. 9A, the flat portion 31A of the first side section 31 is parallel to the imaginary straight line L. The edge portion 32A of the second side section 32 is parallel to or perpendicular to the imaginary straight line L.

The heat exchanger case 2B has a rectangular parallelepiped shape. The heat exchanger case 2B includes a first side section 61 to a sixth side section 66 present in positions corresponding to the six surfaces of the rectangular parallelepiped. In the heat exchanger case 2B, the suction port 7 is formed in the first side section 61 among the six side sections. An outflow port 72 is formed in the second side section 62 present in a position opposed to the first side section 61. In this embodiment, each of the third side section 63, the fourth side section 64, the fifth side section 65, and the sixth side section 66 of the heat exchanger case 2B forms a sidewall without an opening formed therein.

In this embodiment, the outflow port 72 is formed by opening almost the entire second side section 62. That is, the outflow port 72 is defined by an edge portion 62A of the second side section 62. The suction port 7 is formed by opening a part of all of the first side section 61. The first side section 61 includes an edge portion 61A and the suction port 7. The edge portion 61A of the first side section 61 is parallel to the Y direction or the Z direction. The edge portion 62A of the second side section 62 is parallel to the Y direction or the Z direction.

In the fan unit 1A in this embodiment, the axial direction A of the rotating shaft 27 for rotating the impeller 21 is parallel to the Y direction (the imaginary straight line L). The blowout port 9 is located on the outer side in the radial direction of the impeller 21.

The fan case 2A includes a unit connecting portion 41 connected to the heat exchanger case 2B. Specifically, the fan case 2A includes the unit connecting portion 41 for connecting the heat exchange unit 1B to the second side section 32 on the inflow port 71 side. The heat exchanger case 2B includes a unit connecting portion 42 connected to the unit connecting portion 41 of the fan case 2A.

In this embodiment, the unit connecting portion 41 of the fan case 2A includes the edge portion 32A of the second side section 32. The unit connecting portion 42 of the heat exchanger case 2B includes the edge portion 62A of the second side section 62. That is, the edge portion 32A having a frame-like square shape defining the inflow port 71 of the second side section 32 of the fan case 2A functions as the unit connecting portion 41 of the case 2A. The edge portion 62A having a frame-like square shape defining the outflow port 72 of the second side section 62 of the heat exchanger case 2B functions as the unit connecting portion 42 of the heat exchanger case 2B. Specifically, the edge portion 62A of the heat exchanger case 2B includes one or a plurality of ridges projecting to the edge 32A side of the fan case 2A. The edge portion 32A of the fan case 2A includes a plurality of screw holes. In a state in which the edge portion 32A of the fan case 2A is laid on the ridges of the edge portion 62A of the heat exchanger case 2B, the edge portion 32A is screwed and fixed to the ridges by screws inserted through the screw holes. Consequently, the edge portions 32A and 62A are connected and the fan unit 1A and the heat exchange unit 1B are coupled.

In the fan unit 1A in this embodiment, as shown in FIG. 9A, the air guide passage 81 is provided between the hub 23 and the inner surface S3 of the third side section 33.

Therefore, it is possible to reduce the airflow resistance in the downstream side space 12.

In the fan unit 1A in this embodiment, as shown in FIG. 9A, the distance D4 between the inner surface S4 (the opening side inner surface S4) of the fourth side section 34 and the peripheral edge portion of the opening 13 is larger than the distance D3 between the inner surface S3 (the hub side inner surface S3) of the third side section 33 and the hub 23. Therefore, the amount of the air and the size of the passage can be well balanced. Consequently, it is possible to reduce the airflow resistance.

In the fan unit 1A in this embodiment, as shown in FIG. 9B, the distance D6 between the inner surface S6 (the downstream side inner surface S6) of the sixth side section 36 present on the downstream side in the rotating direction of the impeller 21 and the impeller 21 is larger than the distance D5 between the inner surface S5 (the upstream side inner surface S5) of the fifth side section 35 present on the upstream side in the rotating direction B and the impeller 21. Therefore, it is possible to efficiently convert a dynamic pressure obtained by the rotation of the impeller 21 into a static pressure.

In the fan unit 1A in this embodiment, the air flowing into the fan unit 1A from the inflow port 71 is smoothly guided to the opening 13 side along the inclined portion 19*b*. Therefore, it is possible to reduce the airflow resistance.

[Other Modifications]

Figure 7:
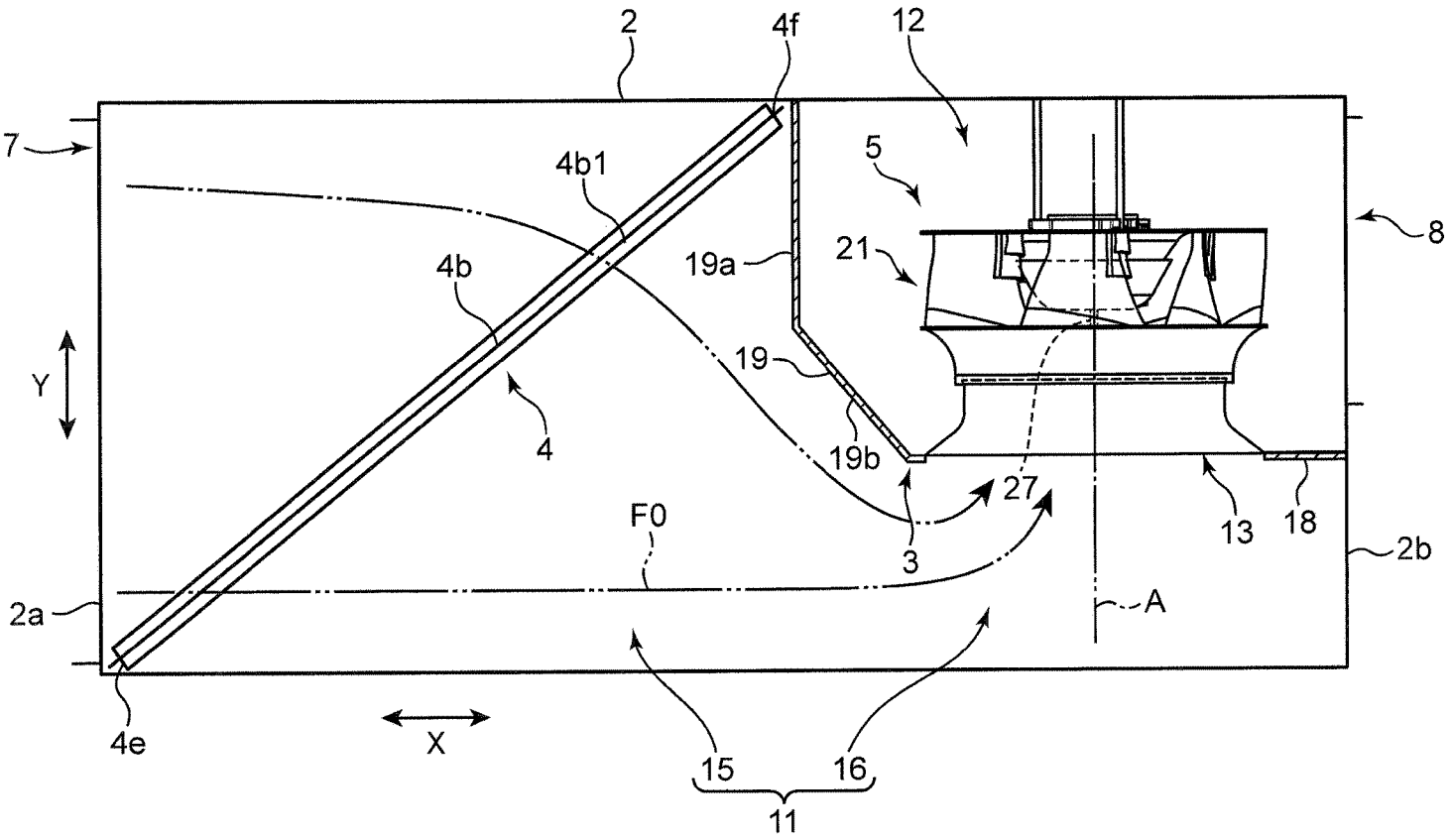
FIG. 7 is an internal configuration diagram of a duct-type indoor unit according to a modification of the embodiment of the present invention.

Note that, in the example explained in the embodiment, the pair of heat exchangers 4 are arranged to open in the V cross-sectional shape. However, the present invention is not limited to this. Heat exchangers having various shapes and arranged in various ways may be adopted. For example, as a modification of the embodiment of the present invention, as shown in FIG. 7, one large heat exchanger 4 may be arranged inside the heat exchange chamber 15 in an inclined toward the suction port 7 of the casing 2 with respect to the width direction Y of the casing 2. In this heat exchanger 4, the straight tube portions 4*b*1 of the heat transfer tubes 4*b* are arranged side by side in a direction from an edge 4*e* on the upstream side of the heat exchanger 4 toward an edge 4*f* on the downstream side of the heat exchanger 4. The straight tube portions 4*b*1 are arranged to be parallel to one another. That is, each of the straight tube portions 4*b*1 extends along a direction (i.e., the direction Z) perpendicular to the direction X and the direction Y. The direction Y is parallel to the rotating shaft 27 (the axial direction A). The edge 4*e* on the upstream side of the heat exchanger 4 extends along the edge of the suction port 7 of the casing 2 in the direction Z. When the heat exchanger 4 is arranged in this way, as in the embodiment, the air introduced into the casing 2 from the suction port 7 can flow while being in contact with the all straight tube portions 4*b*1 of the heat transfer tube 4*b* when the air passes through the heat exchanger 4. It is possible to uniformly cool or heat the plurality of heat transfer tubes 4*b* with the air. Therefore, a difference in cooling or heating performance of the refrigerant among the paths is eliminated.

In the example explained in the embodiment, the air conditioner is the duct-type indoor unit 1. However, the present invention is not limited to the duct-type indoor unit 1 and can also be applied to an air conditioner not connected to a duct.

In the example explained in the embodiment, the blowout port 9 is provided in the first side section 31 and the suction port 7 is provided in the second side section 32 (the blowout port 9 is provided in the position opposed to the suction port 7). However, the present invention is not limited to this. The blowout port 9 may be provided, for example, in any one of the third side section 33, the fourth side section 34, the fifth side section 35, and the sixth side section 36.

Note that the embodiment is outlined below.

The fan unit in the embodiment is a fan unit to be connected to a heat exchange unit in which a heat exchanger is housed. The fan unit includes a fan case, a partition member, and a centrifugal fan. The fan case has an air inflow port and an air blowout port. The fan case includes, in a side section on the inflow port side, a unit connecting portion for connecting the heat exchange unit. The partition member partitions an inside of the fan case into an upstream side space on the inflow port side and a downstream side space on the blowout port side. The partition member has an opening for allowing the upstream side space and the downstream side space to communicate with each other. The centrifugal fan includes an impeller including a plurality of backward curved blades. The centrifugal fan is arranged such that the impeller is located in the downstream side space and sucks air in the upstream side space through the opening. The blowout port is located on the outer side in a radial direction of the impeller in the downstream side space.

In this configuration, since the blowout port is located on the outer side in the radial direction of the impeller, it is possible to smoothly blow out, from the blowout port 9, the air discharged from the impeller. Therefore, in this configuration, since the wind guide plate described in Japanese Unexamined Patent Publication No. H6-281194 is unnecessary, it is possible to suppress an increase in the airflow resistance while suppressing an increase in the number of components.

In the fan unit, it is preferable that the impeller includes a shroud located on the opening side in an axial direction of a rotating shaft for rotating the impeller, and a hub located on the opposite side to the shroud in the axial direction, the fan case has a hub side inner surface present in a position on the opposite side to the opening with respect to the impeller in the axial direction so as to be opposed to the hub in the axial direction, and an air guide passage is provided between the hub and the hub side inner surface, the air guide passage is configured to guide, to the blowout port side, a part of air discharged in a direction different from the blowout port side, out of air discharged from the impeller.

In this configuration, since the air guide passage is provided between the hub and the hub side inner surface, it is possible to reduce the airflow resistance in the downstream side space.

In the fan unit, it is preferable that the fan case has an opening side inner surface present in a position on the opposite side to the hub side inner surface with respect to the impeller and the opening in the axial direction so as to be opposed to the opening in the axial direction, and a distance between the opening side inner surface and a peripheral edge portion of the opening is larger than a distance between the hub side inner surface and the hub.

An amount of the air flowing into the impeller through the opening is larger than an amount of the air passing through the air guide passage between the hub and the hub side inner surface. Therefore, when the distance between the opening side inner surface and the peripheral edge portion of the opening is larger than the distance between the hub side inner surface and the hub as in this configuration, the amount of the air and the size of the passage can be well balanced. Consequently, it is possible to further reduce the airflow resistance.

In the fan unit, it is preferable that the fan case has an upstream side inner surface and a downstream side inner surface located on the outer side in the radial direction with respect to the impeller and the upstream side inner surface is located in a position on the opposite side to the downstream side inner surface with respect to the impeller in the radial direction, the partition member has a partition inner surface located on the outer side in the radial direction with respect to the impeller and the partition inner surface is present in a position on the opposite side to the blowout port with respect to the impeller in the radial direction, the upstream side inner surface, the partition inner surface, and the downstream side inner surface are provided side by side in this order in a rotating direction of the impeller, and a distance between the downstream side inner surface and the impeller is larger than a distance between the upstream side inner surface and the impeller.

In this configuration, since the distance between the downstream side inner surface present on the downstream side in the rotating direction of the impeller and the impeller is larger than the distance between the upstream side inner surface present on the upstream side in the rotating direction and the impeller, it is possible to efficiently convert a dynamic pressure obtained by the rotation of the impeller into a static pressure.

In the fan unit, it is preferable that the partition member includes a first partition plate provided in a position opposed to the impeller in the axial direction of a rotating shaft for rotating the impeller, the opening being formed in the first partition plate, and a second partition plate provided on the inflow port side with respect to the impeller, and closing the inflow port side in the downstream side space, the second partition plate includes an inclined portion inclined toward the first partition plate side with respect to the axial direction, one end of the inclined portion is connected to an end of the first partition plate on the inflow port side, and the other end of the inclined portion is located further on the impeller side than the first partition plate in the axial direction.

In this configuration, since the air flowing into the fan unit from the inflow port is smoothly guided to the opening side along the inclined portion, it is possible to reduce the airflow resistance.

The air conditioner of the present invention includes a casing, a partition member, a heat exchanger, and a centrifugal fan. The casing has an air suction port and an air blowout port. The partition member partitions an inside of the casing into a first space on the suction port side and a second space on the blowout port side. The partition member has an opening for allowing the first space and the second space to communicate with each other. The heat exchanger is arranged in the first space. The centrifugal fan includes an impeller including a plurality of backward curved blades. The centrifugal fan is arranged such that the impeller is located in the second space and sucks the air in the first space through the opening. The blowout port is located on the outer side in a radial direction of the impeller in the second space.

In this configuration, since the blowout port is located on the outer side in the radial direction of the impeller in the second space, it is possible to smoothly blowout, from the blowout port, the air discharged from the impeller. Therefore, in this configuration, since the wind guide plate described in Japanese Unexamined Patent Publication No. H6-281194 is unnecessary, it is possible to suppress an increase in the airflow resistance while suppressing an increase in the number of components.

In the air conditioner, it is preferable that the impeller includes a shroud located on the opening side in the axial direction of a rotating shaft for rotating the impeller, and a hub located on the opposite side to the shroud in the axial direction, the casing has a hub side inner surface present in a position on the opposite side to the opening with respect to the impeller in the axial direction so as to be opposed to the hub in the axial direction, and an air guide passage is provided between the hub and the hub side inner surface, an air guide passage is configured to guide, to the blowout port side, a part of air discharged in a direction different from the blowout port side, out of air discharged from the impeller.

In this configuration, since the air guide passage is provided between the hub and the hub side inner surface, it is possible to reduce the airflow resistance in the second space.

In the air conditioner, it is preferable that the casing has an opening side inner surface present in a position on the opposite side to the hub side inner surface with respect to the impeller and the opening in the axial direction so as to be opposed to the opening in the axial direction, and a distance between the opening side inner surface and a peripheral edge portion of the opening is larger than a distance between the hub side inner surface and the hub.

An amount of the air flowing into the impeller through the opening is larger than an amount of the air passing through the air guide passage between the hub and the hub side inner surface. Therefore, when the distance between the opening side inner surface and the peripheral edge portion of the opening is larger than the distance between the hub side inner surface and the hub as in this configuration, the amount of the air and the size of the passage can be well balanced. Consequently, it is possible to further reduce the airflow resistance.

In the air conditioner, it is preferable that the casing has an upstream side inner surface and a downstream side inner surface located on the outer side in the radial direction with respect to the impeller and the upstream side inner surface is located in a position on the opposite side to the downstream side inner surface with respect to the impeller in the radial direction, the partition member has a partition inner surface located on the outer side in the radial direction with respect to the impeller and the partition inner surface is present in a position on the opposite side to the blowout port with respect to the impeller in the radial direction, the upstream side inner surface, the partition inner surface, and the downstream side inner surface are provided side by side in this order in a rotating direction of the impeller, and a distance between the downstream side inner surface and the impeller is larger than a distance between the upstream side inner surface and the impeller.

In this configuration, since the distance between the downstream side inner surface present on the downstream side in the rotating direction of the impeller and the impeller is larger than the distance between the upstream side inner surface present on the upstream side in the rotating direction and the impeller, it is possible to efficiently convert a dynamic pressure obtained by the rotation of the impeller into a static pressure.

In the air conditioner, it is preferable that the partition member includes a first partition plate provided in a position opposed to the impeller in the axial direction of a rotating shaft for rotating the impeller, the opening being formed in the first partition plate, and a second partition plate provided on the suction port side with respect to the impeller, and closing the suction port side in the second space, the second partition plate includes an inclined portion inclined toward the first partition plate side with respect to the axial direction, one end of the inclined portion is connected to an end of the first partition plate on the suction port side, and the other end of the inclined portion is located further on the impeller side than the first partition plate in the axial direction.

In this configuration, since the air having passed through the heat exchanger is smoothly guided to the opening side along the inclined portion, it is possible to reduce the airflow resistance.

In the air conditioner, it is preferable that the suction port, the heat exchanger, the centrifugal fan, and the blowout port are arrayed in a row in a direction orthogonal to the axial direction of the impeller.

In this configuration, since the suction port, the heat exchanger, the centrifugal fan, and the blowout port is linearly arrayed in the direction (the X direction in FIG. 2) orthogonal to the axial direction, it is possible to reduce the dimension in the width direction and the dimension in the height direction of the casing. In this configuration, it is possible to linearly arrange a suction duct and a blowout duct along the array direction (see FIG. 1).

This application is based on Japanese Patent application No. 2013-188510 filed in Japan Patent Office on Sep. 11, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A fan unit to be connected to a heat exchange unit in which a heat exchanger is housed, the fan unit comprising:

a fan case having an air inflow port and an air blowout port and including, in a side section of the fan case on the inflow port side, a unit connecting portion for connecting the heat exchange unit;

a partition member that partitions an inside of the fan case into an upstream side space on the inflow port side and a downstream side space on the blowout port side, the partition member having an opening for allowing the upstream side space and the downstream side space to communicate with each other; and a centrifugal fan including a fan motor having a rotation shaft and an impeller rotating by the fan motor, the centrifugal fan being configured such that the impeller is located in the downstream side space and sucks air in the upstream side space through the opening, wherein the opening of the partition member is located on an extended line of the rotation shaft, the impeller includes:

a hub fixed to the rotation shaft of the fan motor;

a shroud having an air suction port located on the extended line of the rotation shaft; and a plurality of backward curved blades arranged between the hub and the shroud and fixed to the hub and the shroud, the fan case includes:

a supporting wall having an inner surface perpendicular to the rotation shaft of the fan motor, the supporting wall supporting the fan motor;

an opposite wall having an inner surface perpendicular to the rotation shaft of the fan motor and disposed oppositely to the supporting wall across the impeller in an extending direction in which the rotation shaft extends; and a connecting wall facing the impeller in a radial direction thereof and connecting an edge of the supporting wall and an edge of the opposite wall with each other, wherein the blowout port is provided at the connecting wall and faces the impeller in the radial direction of the impeller in the downstream side space, the inner surface of the supporting wall, the hub, the opening, and the inner surface of the opposite wall are juxtaposed in the extending direction of the rotation shaft in this order, the inner surface of the supporting wall and the hub define an air guide passage, the air guide passage being configured to guide a part of air discharged from the impeller to the blowout port, and a distance between the inner surface of the opposite wall and a peripheral edge portion defining the opening is longer than a distance between the inner surface of the supporting wall and the hub in the extending direction of the rotation shaft.

2. The fan unit according to claim 1, wherein the fan case has an upstream side inner surface and a downstream side inner surface, the upstream side inner surface being disposed oppositely to the downstream side inner surface across the impeller in the radial direction thereof, the partition member has a partition inner surface facing the impeller in the radial direction, the partition inner surface being disposed oppositely to the blowout port across the impeller in the radial direction, the upstream side inner surface, the partition inner surface, and the downstream side inner surface are provided side by side in this order in a rotating direction of the impeller, and a distance between the downstream side inner surface and the impeller is longer than a distance between the upstream side inner surface and the impeller.

3. A fan unit to be connected to a heat exchange unit in which a heat exchanger is housed, the fan unit comprising:

a fan case having an air inflow port and an air blowout port and including, in a side section of the fan case on the inflow port side, a unit connecting portion for connecting the heat exchange unit:

a partition member that partitions an inside of the fan case into an upstream side space on the inflow port side and a downstream side space on the blowout port side, the partition member having an opening for allowing the upstream side space and the downstream side space to communicate with each other; and a centrifugal fan including a fan motor having a rotation shaft and an impeller rotating by the fan motor, the centrifugal fan being configured such that the impeller is located in the downstream side space and sucks air in the upstream side space through the opening, wherein the opening of the partition member is located on an extended line of the rotation shaft, the fan case includes:

a supporting wall having an inner surface perpendicular to the rotation shaft of the fan motor, the supporting wall supporting the fan motor;

an opposite wall having an inner surface perpendicular to the rotation shaft of the fan motor and disposed oppositely to the supporting wall across the impeller in an extending direction in which the rotation shaft extends; and a connecting wall facing the impeller in a radial direction thereof and connecting an edge of the supporting wall and an edge of the opposite wall with each other, wherein the blowout port is provided at the connecting wall and faces the impeller in the radial direction of the impeller in the downstream side space, and the partition member includes:

a first partition plate interposed between the impeller and the opposite wall, the first partition plate having the opening; and a second partition plate disposed oppositely to the connecting wall across the impeller in the radial direction thereof and connected to the first partition plate, wherein the second partition plate includes an inclined portion that is continuous with the first partition plate, the inclined portion inclining with respect to the extended line of the rotation shaft and extending from an end of the first partition plate toward the supporting wall so as to be away from the extended line of the rotation shaft in the radial direction of the impeller.

4. An air conditioner comprising:

a casing having an air suction port and an air blowout port;

a partition member that partitions an inside of the casing into a first space on the suction port side and a second space on the blowout port side, the partition member having an opening for allowing the first space and the second space to communicate with each other;

a heat exchanger arranged in the first space; and a centrifugal fan including a fan motor having a rotation shaft and an impeller rotating by the fan motor, the centrifugal fan being configured such that the impeller is located in the second space and sucks air in the first space through the opening, wherein the opening of the partition member is located on an extended line of the rotation shaft, the impeller includes:

a hub fixed to the rotation shaft of the fan motor;

a shroud having an air suction port located on the extended line of the rotation shaft; and a plurality of backward curved blades arranged between the hub and the shroud and fixed to the hub and the shroud, the casing includes:

a supporting wall having an inner surface perpendicular to the rotation shaft of the fan motor, the supporting wall supporting the fan motor;

an opposite wall having an inner surface perpendicular to the rotation shaft of the fan motor and disposed oppositely to the supporting wall across the impeller in an extending direction in which the rotation shaft extends; and a connecting wall facing the impeller in a radial direction thereof and connecting an edge of the supporting wall and an edge of the opposite wall with each other, wherein the blowout port is provided at the connecting wall and faces the impeller in the radial direction of the impeller in the downstream side space, the inner surface of the supporting wall, the hub, the opening, and the inner surface of the opposite wall are juxtaposed in the extending direction of the rotation shaft in this order, the inner surface of the supporting wall and the hub define an air guide passage, the air guide passage being configured to guide a part of air discharged from the impeller to the blowout port, and a distance between the inner surface of the opposite wall and a peripheral edge portion defining the opening is longer than a distance between the inner surface of the supporting wall and the hub in the extending direction of the rotation shaft.

5. The air conditioner according to claim 4, wherein the casing has an upstream side inner surface and a downstream side inner surface, the upstream side inner surface being disposed oppositely to the downstream side inner surface across the impeller in the radial direction thereof, the partition member has a partition inner surface facing the impeller in the radial direction, the partition inner surface being disposed oppositely to the blowout port across the impeller in the radial direction, the upstream side inner surface, the partition inner surface, and the downstream side inner surface are provided side by side in this order in a rotating direction of the impeller, and a distance between the downstream side inner surface and the impeller is longer than a distance between the upstream side inner surface and the impeller.

6. The air conditioner according to claim 4, wherein the partition member includes:

a first partition plate interposed between the impeller and the opposite wall, the first partition plate having the opening; and a second partition plate disposed oppositely to the connecting wall across the impeller in the radial direction thereof and connected to the first partition plate, wherein the second partition plate includes an inclined portion that is continuous with the first partition plate, the inclined portion inclining with respect to the extended line of the rotation shaft and extending from an end of the first partition plate toward the supporting wall so as to be away from the extended line of the rotation shaft in the radial direction of the impeller.

7. The air conditioner according to claim 4, wherein the suction port, the heat exchanger, the centrifugal fan, and the blowout port are arrayed in a row in a direction orthogonal to the extending direction of the rotation shaft.

* * * * *